US006267367B1

(12) United States Patent
Pfankuch

(10) Patent No.: US 6,267,367 B1
(45) Date of Patent: Jul. 31, 2001

(54) DEVICE FOR COLLECTING AND TRANSFERRING CUT PAPER PRODUCTS OR THE LIKE

(75) Inventor: Claus Karl Pfankuch, Hamburg (DE)

(73) Assignee: Pfankuch Maschinen GmbH, Ahrensburg (DE)

( * ) Notice: Subject to any disclaimer, the term of this patent is extended or adjusted under 35 U.S.C. 154(b) by 0 days.

(21) Appl. No.: 09/457,565

(22) Filed: Dec. 9, 1999

(30) Foreign Application Priority Data

Dec. 14, 1998 (DE) ..... 298 22 224 U

(51) Int. Cl.[7] ..... B65H 5/22

(52) U.S. Cl. ..... 271/3.05; 271/3.2; 271/4.1; 271/10.11; 271/100; 271/104; 271/207

(58) Field of Search ..... 271/268, 3.2, 4.1, 271/10.11, 100, 104, 207

(56) References Cited

U.S. PATENT DOCUMENTS

| | | | | |
|---|---|---|---|---|
| 2,855,195 | * | 10/1958 | Young . | |
| 4,358,100 | * | 11/1982 | Muller | 271/11 |
| 4,491,311 | * | 1/1985 | Glanzmann | 270/52.27 |
| 4,540,168 | * | 9/1985 | Stobb | 271/101 |
| 4,569,622 | | 2/1986 | Buck . | |
| 5,116,303 | * | 5/1992 | Dietrich et al. | 493/313 |
| 5,174,559 | * | 12/1992 | Diamantides | 271/12 |
| 5,259,609 | * | 11/1993 | Brame et al. | 271/213 |
| 5,308,056 | * | 5/1994 | Achelpohl | 271/183 |
| 5,375,834 | * | 12/1994 | Rathert | 271/310 |
| 5,535,998 | * | 7/1996 | Geffert et al. | 271/99 |
| 5,622,360 | * | 4/1997 | Rathert et al. . | |
| 5,833,229 | * | 11/1998 | Prim | 271/11 |
| 5,979,889 | * | 11/1999 | Klopfenstein | 271/11 |
| 6,015,145 | * | 1/2000 | Hartel | 271/98 |
| 6,070,866 | * | 6/2000 | Wepfer | 271/10.11 |

FOREIGN PATENT DOCUMENTS

| | | |
|---|---|---|
| 1919800 | 12/1969 | (DE) . |
| 196 07 708 C1 | 9/1997 | (DE) . |
| 0337039 | 10/1989 | (EP) . |

* cited by examiner

*Primary Examiner*—Robert P. Olszewski
*Assistant Examiner*—Richard Ridley
(74) *Attorney, Agent, or Firm*—Friedrich Kueffner

(57) ABSTRACT

A device for collecting and transferring cut products has an in-process storage device and a feeder feeding a stream of the cut products to the in-process storage device. The in-process storage device has a collecting tray in which the cut products fed by the feeder are collected. A transport device is provided for transporting the cut products away from the in-process storage device. A rotatably driven transfer drum is positioned underneath the collecting tray. The rotatably driven transfer drum has a gripping device that grips in a gripping position a preset number of the cut products collected in the collecting tray and moves the preset number of the cut products to the transport device by rotation of the rotatably driven transfer drum by a preset rotary angle.

7 Claims, 2 Drawing Sheets

DEVICE FOR COLLECTING AND TRANSFERRING CUT PAPER PRODUCTS OR THE LIKE

BACKGROUND OF THE INVENTION

1. Field of the Invention

The invention relates to a device for collecting and transferring cut paper products etc., comprising a feeder for the cut products to be collected, a storage device for collecting the cut products, and a transport device for the collected cut products.

2. Description of the Related Art

Such devices are known in various embodiments. They are designed to collect flat paper sheets, plastic sleeves etc., which are usually very soft and flexible and are therefore difficult to manipulate. These products, which are, in general, referred to as cut products or blanks, are continuously fed without interruption by the feeder in order to be collected as a stack of a larger or smaller number of sheets and to then be placed onto the transport device.

SUMMARY OF THE INVENTION

It is an object of the present invention to provide a device of the aforementioned kind which collects reliably such flexible cut products or blanks at high speed and which is at the same time of a compact design, i.e., requires minimal space.

In accordance with the present invention, this is achieved in that at the entrance of the storage device a collecting tray for collecting the cut products is provided and that below the collecting tray a rotatably driven transfer drum is positioned having a gripping device for a selected number of collected cut products and for placing the selected number of collected cut products onto the transport device after rotation of the transfer drum by a preset angle.

Inventively, an in-process storage device having a collecting tray is provided to which the cut products to be collected are supplied continuously. When a certain number of cut products has been received in the collecting tray, the cut products are transferred onto the rotatably driven transfer drum without having to interrupt the feeding action of further cut products to the collecting tray. The rotary speed of the transfer drum is so great that it is always ready to receive a new stack of collected cut products when the selected number is present in the collecting tray. The preset number of cut products collected in the collecting tray and stacked therein are gripped by the gripping device and placed onto the transport device by rotation of the transfer drum about the preset rotary angle. The rotary movement of the transfer drum continues until it is again in the receiving position in which a new stack of cut products can be received from the collecting tray. This device can be realized in a compact design as a table model wherein the transfer drum is positioned below the plane of the collecting tray.

The device is, in particular, designed such that the gripping device has a gripping member which is moveable into a securing or gripping position by pivoting counter to the rotational direction of the transfer drum.

In a preferred embodiment, separating fingers are provided between the collecting tray and the transfer drum. They separate the preset number of collected cut products from the following cut products and transfer them onto the gripping device.

The separating fingers are arranged on a rotatably driven rotor and extend parallel to the axis of rotation of the rotor, wherein the axis of rotation of the rotor is parallel to the rotational axis of the transfer drum.

Preferably, two symmetrically arranged and oppositely positioned rotors with facing separating fingers are provided.

At the exit of the collecting tray a separator for separating the desired number of cut products is provided. The separator is realized as a flat separating blade that can be moved between the cut products fed to and received in the collecting tray.

The rotary angle of the transfer drum, at which the placement of the cut products onto the transport device occurs, is determined by a stripping blade. The angle is approximately 180°.

Especially the arrangement of the separating fingers at corresponding rotors ensures that the collected stack in the collecting tray is moved or forced into the area of the gripping device of the transfer drum.

The rotary speed of the transfer drum and of the rotors which support the separating fingers is synchronized so that a cycled transfer can take place. Advantageously, the rotary transfer drum and the rotors have separate drives.

DESCRIPTION OF THE PREFERRED EMBODIMENTS

Figure 3:
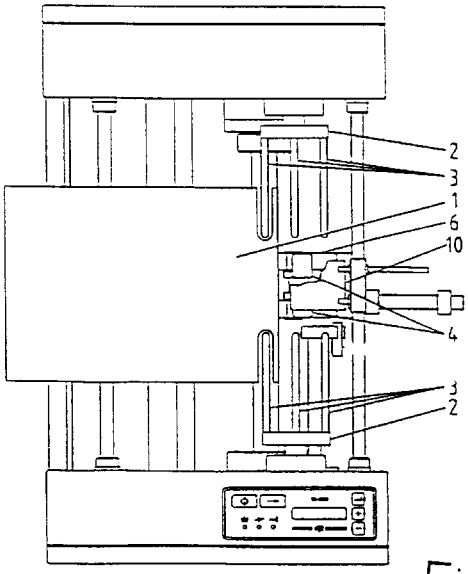
FIG. 3 is a plan view of the device of FIG. 1.
Figure 4:
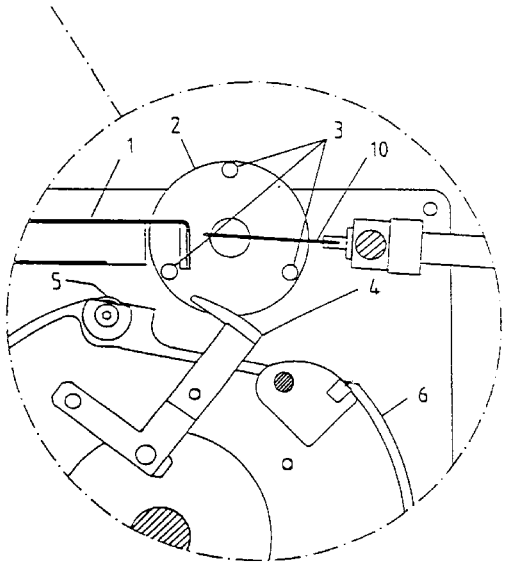
FIG. 4 shows a detail of FIG. 1 at an enlarged scale for illustrating in more detail the transfer area between the collecting tray and the transfer drum.

The drawing shows a device comprising an in-process storage device with a collecting tray 1 for collecting the cut products 13 that are continuously supplied at high velocity. The collecting tray 1 is open in the downward direction at its side facing away from the feeder. This allows gripping of a collected cut product stack 13 by the separating fingers 3 and bending of the of the stack 13 in the downward direction toward the transfer drum 6. The separating fingers 3 are arranged on a rotor 2 having its own drive 11. FIG. 3 illustrates that two such separating devices, including rotors 2 and separating fingers 3, are positioned symmetrically to one another and opposite to one another so as to project into the area of the collecting tray 1.

In this area a separator 10 is also provided which comprises a reciprocating separating blade moveable into the interior of the collecting tray 1 in order to separate the desired number of cut products of the stack 13 from the following cut products. It is thus possible to continuously feed the cut products to the collecting tray 1 while a stack 13 with a preset number of cut products is separated and transferred onto the transfer drum 6.

Figure 2:
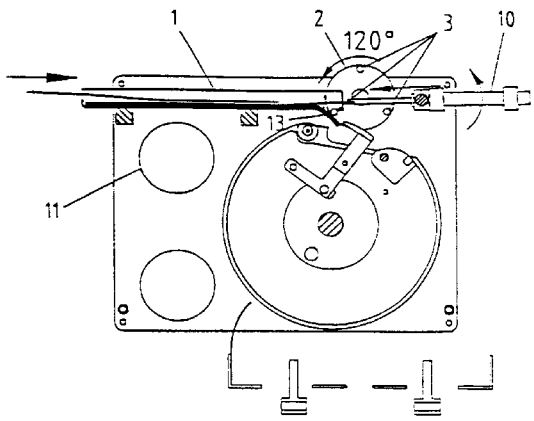
FIG. 2 is a side view corresponding to FIG. 1, but showing the transfer of a collected cut product stack from the collecting tray onto the transfer drum.
Figure 7:
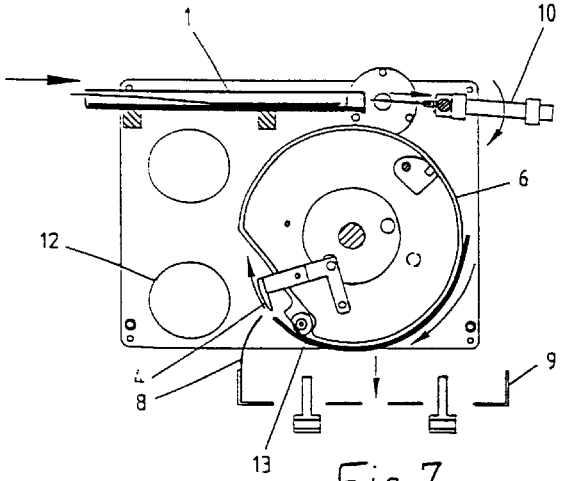
FIG. 7 shows a third transfer step with the stack of cut products reaching the stripping blade.
Figure 8:
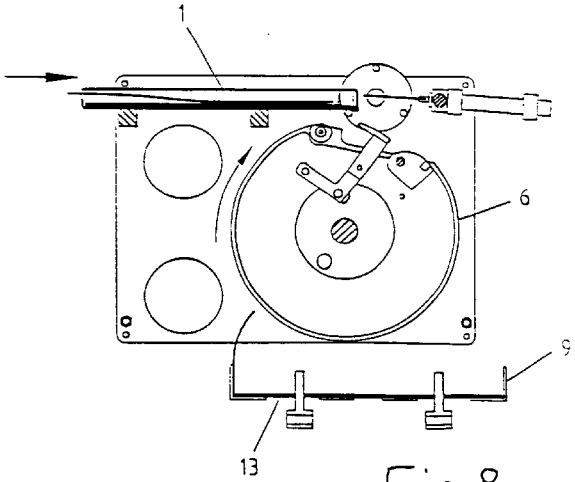
FIG. 8 shows the fourth transfer step with the stack of cut products received on the transport device and the rotary transfer drum returned into its initial position.

This is possible in that a completed stack 13, as indicated in FIG. 2, is gripped and secured by a gripping devices on the transfer drum 6. The gripping device 5 interacts with a gripping member 4 which is rotated counter to the rotational direction of the transfer drum 6 into the gripping or securing position in which it secures the stack 13 comprised of cut products in order to entrain the stack 13 during rotation of the transfer drum 6 until the position shown in FIG. 7 is reached. The stripping blade 8 is provided in order to transfer the stack 13 onto the transport device 9, as shown in FIG. 8.

Figure 5:
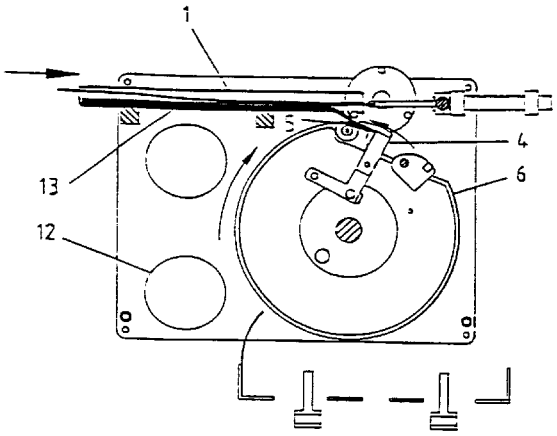
FIG. 5 shows a first transfer step of the transfer onto the transfer drum.

FIG. 5 shows how the gripping member 4 is rotated or pivoted counter to the rotational direction of the transfer drum 6 into its securing or gripping position.

Figure 6:
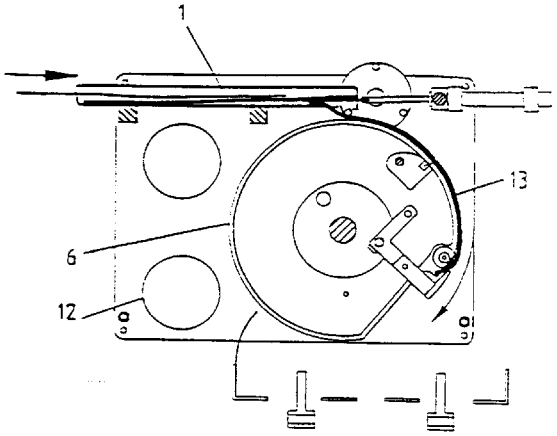
FIG. 6 shows a second transfer step with the stack of cut products moved by the transfer drum away from the collecting tray.

In FIG. 6 an intermediate position is shown in which the transfer drum 6 has moved through a portion of its rotary angle.

Figure 1:
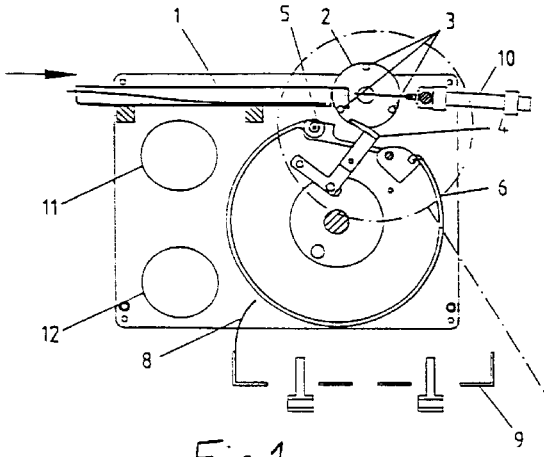
FIG. 1 is a schematic side view of one embodiment of the inventive device.

The rotary velocity of the transfer drum 6 must be so high that it reaches the initial position of FIG. 1 before a new stack of cut products has been completed in the collecting tray 1. Accordingly, the rotary speed of the transfer drum 6 must be synchronized to that of the rotors 2 and of the reciprocating movement of the separating blade 10. The transfer drum 6 has its own drive 12 so that the very different speeds of the transfer drum 6 and of the rotors 2 can be realized without difficulty.

The device is relatively compact because the transfer drum 6 has a relatively small circumference which is approximately twice the length of the cut products. The transfer drum 6 can be arranged below the plane of the feeder and the collecting tray 1.

While specific embodiments of the invention have been shown and described in detail to illustrate the inventive principles, it will be understood that the invention may be embodied otherwise without departing from such principles.

What is claimed is:

1. A device for collecting and transferring cut products, the device comprising:

an in-process storage device;

a feeder configured to feed a stream of the cut products to the in-process storage device;

the in-process storage device having a collecting tray configured to collect the cut products fed by the feeder;

a transport device configured to transport the cut products away from the in-process storage device;

a rotatably driven transfer drum positioned underneath the collecting tray;

the rotatably driven transfer drum rotating about a rotation axis and having a gripping device configured to grip in a gripping position a preset number of the cut products collected in the collecting tray and to move the preset number of the cut products to the transport device by rotation of the rotatably driven transfer drum by a preset rotary angle about the rotation axis, further comprising separating fingers positioned between the collecting tray and the rotatably driven transfer drum, the separating fingers configured to separate the preset number of the cut products from the stream of the cut products fed by the feeder to the in-process storage device and to transfer the preset number of the cut products to the gripping device, further comprising at least one driven rotor rotating about an axis of rotation, wherein the separating fingers are connected to the driven rotor and extend in a direction parallel to the axis of rotation, wherein the axis of rotation of the driven rotor is parallel to the rotation axis of the rotatable driven transfer drum.

2. The device according to claim 1, wherein the gripping device has a pivotable gripping member configured to pivot into the gripping position counter to a direction of rotation of the rotatably driven transfer drum.

3. The device according to claim 1, wherein two of the driven rotors are arranged symmetrically opposed to one another on opposite sides of the rotatably driven transfer drum and wherein the separating fingers of the driven rotors face one another.

4. The device according to claim 1, further comprising a separator configured to separate the preset number of the cut products from the stream of the cut products.

5. The device according to claim 4, wherein the separator has a flat separating blade configured to be moved between individual ones of the cut products collected in the collecting tray.

6. The device according to claim 1, further comprising a stripping blade, wherein the preset rotary angle of the rotatably driven transfer drum is determined by a position of the stripping blade at the rotatably driven transfer drum.

7. The device according to claim 6, wherein the rotary angle of the rotatably driven transfer drum is approximately 180°.

* * * * *